US008288971B2

(12) United States Patent
Jiang

(10) Patent No.: US 8,288,971 B2
(45) Date of Patent: Oct. 16, 2012

(54) INTEGRATED AND PROGRAMMABLE MICROPHONE BIAS GENERATION

(75) Inventor: Xicheng Jiang, Irvine, CA (US)

(73) Assignee: Broadcom Corporation, Irvine, CA (US)

( * ) Notice: Subject to any disclaimer, the term of this patent is extended or adjusted under 35 U.S.C. 154(b) by 1315 days.

(21) Appl. No.: 12/008,570

(22) Filed: Jan. 11, 2008

(65) Prior Publication Data

US 2009/0180644 A1 Jul. 16, 2009

(51) Int. Cl.
*H04R 3/00* (2006.01)

(52) U.S. Cl. ..... 318/122

(58) Field of Classification Search ..... 381/122
See application file for complete search history.

(56) References Cited

U.S. PATENT DOCUMENTS

| | | | | |
|---|---|---|---|---|
| 6,842,525 | B1 * | 1/2005 | Mellot | 381/92 |
| 2004/0208327 | A1 * | 10/2004 | Henson et al. | 381/113 |
| 2006/0008097 | A1 * | 1/2006 | Stenberg et al. | 381/113 |
| 2006/0055375 | A1 * | 3/2006 | Fabbro | 320/132 |
| 2006/0147061 | A1 * | 7/2006 | Niwa et al. | 381/113 |
| 2007/0160234 | A1 * | 7/2007 | Deruginsky et al. | 381/113 |
| 2008/0051918 | A1 * | 2/2008 | Tuttle et al. | 700/94 |
| 2008/0068049 | A1 * | 3/2008 | Welti | 327/108 |
| 2008/0075306 | A1 * | 3/2008 | Poulsen et al. | 381/111 |
| 2008/0310655 | A1 * | 12/2008 | Holzmann | 381/122 |
| 2009/0003629 | A1 * | 1/2009 | Shajaan et al. | 381/113 |
| 2009/0046870 | A1 * | 2/2009 | Turnbull | 381/95 |
| 2010/0013501 | A1 * | 1/2010 | Van Den Boom | 324/679 |

* cited by examiner

*Primary Examiner* — Kiesha Bryant
*Assistant Examiner* — Igwe U Anya
(74) *Attorney, Agent, or Firm* — Farjami & Farjami LLP

(57) ABSTRACT

A disclosed embodiment is a programmable integrated circuit such as an audio processor or a base band processor for generating a low noise and programmable microphone bias voltage or current. The programmable integrated circuit generates a programmable reference input, where the reference input is programmably generated from at least one power source, such as a on-chip audio power supply, an on-chip power supply, or an off-chip power supply, for use by a regulator. The regulator in the programmable integrated circuit receives a bias input and the programmable reference input and generates a programmable output for biasing a microphone. The bias input for the regulator can be provided by an off-chip power supply or an on-chip power supply. The reference input provided to the regulator can be appropriately filtered to reduce noise. In one embodiment, the programmable reference input and the programmable output are programmed by first and second potentiometers, respectively.

20 Claims, 3 Drawing Sheets

INTEGRATED AND PROGRAMMABLE MICROPHONE BIAS GENERATION

BACKGROUND OF THE INVENTION

1. Field of the Invention

The present invention is generally in the field of electrical circuits. More particularly, the present invention relates to low noise bias voltage and current generation.

2. Background Art

Microphones are used in electronic devices to convert sound into electrical signals. The electrical signals outputted by a typical microphone are weak and represented by small voltage or current variations. As such, a stable and low noise microphone bias voltage or current is needed to properly operate a typical microphone. Moreover, different types of microphones and different chips interfacing with the different microphones, e.g. different audio processing or base band integrated circuits (ICs), create an environment in which there is a great need for flexibility to accommodate different voltage and current levels for the different audio processing or base band ICs and the different microphones, while all such different voltage and current biases need to be stable and low noise.

According to conventional techniques, a separate bias generation IC, apart from the chip (e.g. an audio processor or a base band processor) that processes the electrical signals generated by a microphone, is employed to provide a stable and low noise voltage or current bias for the microphone. Moreover, it is presently difficult to easily introduce the numerous precise voltage or current bias conditions required for different types of microphones and for the different types of ICs receiving electrical signals from the microphones. The conventional approach requires modifications to bias generation ICs that are fabricated separately from the audio processing and base band ICs that receive electrical signals from the biased microphones. Inherent in the conventional approach is the increased component count, i.e. the separate bias generation IC, and also the lack of flexibility of the separate bias generation IC to accommodate different microphones and different audio processing or base band ICs.

SUMMARY OF THE INVENTION

Integrated and programmable microphone bias generation, substantially as shown in and/or described in connection with at least one of the figures, and as set forth more completely in the claims.

DETAILED DESCRIPTION OF THE INVENTION

The present invention is directed to integrated and programmable microphone bias generation. Although the invention is described with respect to specific embodiments, the principles of the invention, as defined by the claims appended herein, can obviously be applied beyond the specifically described embodiments of the invention described herein. Moreover, in the description of the present invention, certain details have been left out in order to not obscure the inventive aspects of the invention. The details left out are within the knowledge of a person of ordinary skill in the art.

The drawings in the present application and their accompanying detailed description are directed to merely exemplary embodiments of the invention. To maintain brevity, other embodiments of the invention, which use the principles of the present invention are not specifically described in the present application and are not specifically illustrated by the present drawings.

Figure 1:
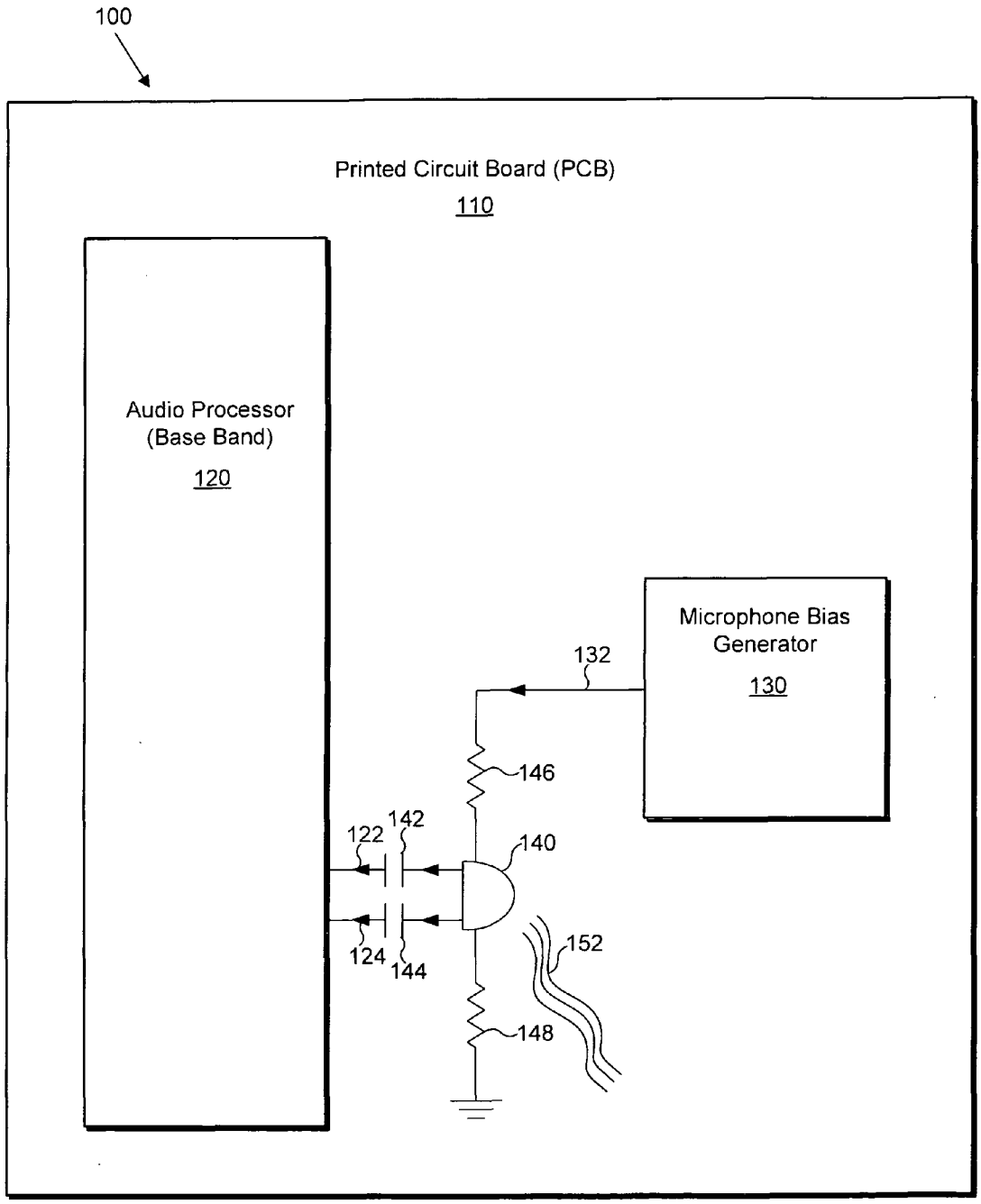
FIG. 1 shows a conventional system, having a microphone bias generator as a distinct component.

Conventional system 100 that includes a typical microphone for converting sound into electrical signals is shown in FIG. 1. Several components are situated on printed circuit board (PCB) 110, including audio processor or base band processor 120 (hereinafter collectively referred to as "audio processor 120" for simplicity), microphone bias generator 130, and microphone 140. Bias voltage or current output 132 of microphone bias generator 130 is coupled to a first terminal of bias resistor 146, and a second terminal of bias resistor 146 is coupled to microphone 140. Microphone 140 is coupled to a first terminal of bias resistor 148, and a second terminal of bias resistor 148 is coupled to ground. Direct-current (DC) blocking capacitors 142 and 144 are interposed, respectively, between microphone 140 and inputs 122 and 124 of audio processor 120.

In operation, microphone bias generator 130 provides bias voltage or current 132 that biases microphone 140 with the aid of bias resistors 146 and 148. When sound signals 152 reach microphone 140, electrical signals are generated by microphone 140, which are then supplied to inputs 122 and 124 of audio processor 120 through capacitors 142 and 144, respectively. The electrical signals received by audio processor 120 may undergo further processing in audio processor 120, e.g. analog to digital conversion may be performed as known in the art.

Microphone 140 can be, for example, an electret microphone. Many different vendors produce microphones, and each vendor may produce its microphone according to a different specification. Thus, conventional systems that include microphones, like conventional system 100, must be designed with a particular vendor's microphone in mind, and may require redesign if a new vendor's microphone is substituted for another one. A given microphone specification may require a specific custom bias condition to operate properly. Thus, replacing microphone 140 with another microphone might require replacing or redesigning microphone bias generator 130, bias resistors 146 and 148, and possibly even DC blocking capacitors 142 and 144 and parts of audio processor 120.

Further compounding the conventional design difficulty is the fact that the electrical signals outputted by microphone 140 to inputs 122 and 124 are usually very small, e.g. a few microvolts. Because the electrical signals outputted by microphone 140 are small, microphone bias generator 130 must output a very low noise bias voltage or current on output 132. However, microphone bias generator 130 must also be versatile enough to receive power from various power sources (not shown). For example, PCB 110 might be used in a system that is required to receive power from a battery, from a switching regulator power supply, from a low drop out regulator power supply, or from some external supply. All told, different bias generator designs, all maintaining a very low noise bias voltage or current output, may be required for desired combinations of microphone model and power sources, and thus the design cost for a conventional system, such as conventional system 100, is high.

Figure 2:
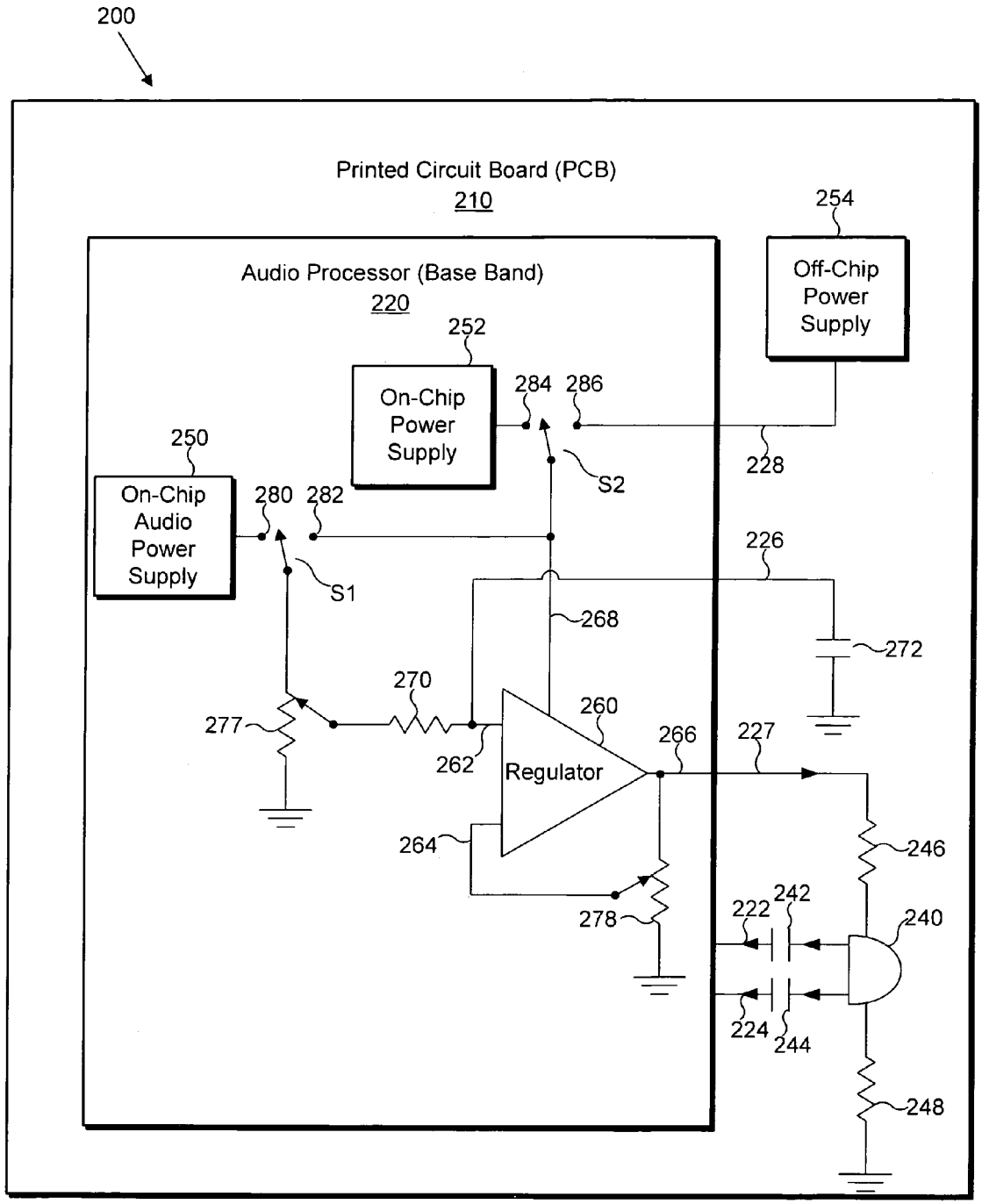
FIG. 2 shows an audio processor for generating a programmable microphone bias output, according to one embodiment of the present invention.

System 200 that includes a typical microphone for converting sound into electrical signals, in accordance with one embodiment of the invention, is shown in FIG. 2. Several components are situated on printed circuit board (PCB) 210, including audio processor or base band processor 220 (hereinafter collectively referred to as "audio processor 220" for simplicity or also as a "programmable integrated circuit"), microphone 240, off-chip power supply 254, and off chip filter capacitor 272. Notably, there is not a distinct microphone bias generator component, as there was in conventional system 100. The output of off-chip power supply 254 is coupled to power supply input 228 of audio processor 220. Filtering capacitor 272 is coupled between input 262 of regulator 260 and ground. Bias voltage or current output 227 of audio processor 220 is provided to microphone 240 through bias resistor 246. Bias resistor 248 is coupled between microphone 240 and ground. Direct-current (DC) blocking capacitors 242 and 244 are interposed, respectively, between microphone 240 and inputs 222 and 224 of audio processor 220.

Notably, in FIG. 1, a bias voltage or current is provided through bias voltage or current output 132 of microphone bias generator 130, which is a component situated on PCB 110 that is distinct from audio processor 120. In contrast, in FIG. 2, the bias voltage or current is not provided by a component that is distinct from audio processor 220, but instead is provided by bias voltage or current output 227 of audio processor 220. This and other differences and improvements provided by the present invention, result in various advantages, such as reducing the overall cost and allowing for the programmable generation of bias voltage or current for microphones.

Switches S1 and S2 can be, for example, typical transistor switches. By, for example, programming switches S1 and S2 into different configurations, audio processor 220 can utilize several combinations of on-chip audio power supply 250, on-chip power supply 252, and off-chip power supply 254 as input to regulator 260. Switch S2 can be programmed into a first configuration to couple bias input 268 of regulator 260 to on-chip power supply 252 through node 284, or into a second configuration to couple bias input 268 of regulator 260 to off-chip power supply 254 through node 286 and power supply input 228. In this fashion, either power supply 252 or 254 can be coupled to bias input 268 of regulator 260.

Switch S1 can be programmed into a first configuration to couple on-chip audio power supply 250 to reference input 262 of regulator 260 through node 280, potentiometer 277, and resistor 270; or into a second configuration to couple on-chip or off-chip power supply 252 or 254 (through node 284 or 286 depending on the position of switch S2) to reference input 262 of regulator 260 through potentiometer 277 and resistor 270. In this fashion, switch S2 controls the input to bias input 268 of regulator 260, while switches S2 and S1 together control the input of potentiometer 277 and reference input 262 of regulator 260.

As shown in FIG. 2, a first terminal of potentiometer 277 is coupled to the output of switch S1, a second terminal of potentiometer 277 is coupled to ground, and a moving terminal, or "wiper," of potentiometer 277 is coupled to a first terminal of resistor 270. A second terminal of resistor 270 is coupled to reference input 262 of regulator 260. By programming potentiometer 277, the resistances between the first (or the second) terminal of potentiometer 277 and the wiper of potentiometer 277 can be varied, and thus the voltage on the wiper of potentiometer 277 can be varied between the voltage on the output of switch S1 and ground. Because reference input 262 is also coupled to filtering capacitor 272 through output 226, resistor 270 and filtering capacitor 272 can act together to filter electrical noise present at reference input 262. Thus, an electrical signal on either node 280 or 282 is provided through switch S1, which is programmably scaled by potentiometer 277, which is then filtered by resistor 270 and filtering capacitor 272 and provided at reference input 262 of regulator 260.

Potentiometer 278 adds another level of programmability. A first terminal of potentiometer 278 is coupled to output 266 of regulator 260, a second terminal of potentiometer 278 is coupled to ground, and a wiper of potentiometer 278 is connected to input 264 of regulator 260. By programming potentiometer 278, the resistances between the first (or the second) terminal of potentiometer 278 and the wiper of potentiometer 278 can be varied, and thus a voltage on the wiper of potentiometer 278 can be varied between a voltage on output 266 of regulator 260 and ground. In this embodiment, regulator 260 can be, for example, a wide band, high gain op-amp (operational amplifier), where regulator 260 is configured as a voltage amplifier. Thus, output 266 voltage is a multiple of the voltage at reference input 262 of regulator 260.

In operation, switch S2 can be programmed by audio processor 220 to couple either on-chip power supply 252 or off-chip power supply 254 to bias input 268 of regulator 260. Switch S1 may then be programmed to couple either on-chip audio power supply 250 or the output of switch S2 to potentiometer 277. Potentiometer 277 can be programmed to vary the output of switch S2 to provide to reference input 262 of regulator 260. Potentiometer 278 can be programmed to establish a multiplying factor for regulator 260. Regulator 260 outputs a desirably programmed low noise bias voltage or current on microphone bias output 227 to properly bias microphone 240. When sound signals reach the properly biased microphone 240, electrical signals are generated by microphone 240, which are supplied to inputs 222 and 224 of audio processor 220 through DC filtering capacitors 242 and 244, respectively. The electrical signals received by audio processor 220 may undergo further processing in audio processor 220, e.g. analog to digital conversion may be performed as known in the art.

In some applications, microphone 240 may be unused for a period of time, and it might not be necessary to provide microphone 240 with a bias voltage or current at all times. According to the present invention, when microphone 240 is idle, bias voltage or current output 266 can be advantageously cut off to reduce the power consumption of system 200. By monitoring microphone electrical signals received at inputs 222 and 224, audio processor 220 can determine whether microphone 240 is active or inactive. If, for a period of time, no electrical signals are received from microphone 240, a power management unit in audio processor 220 can cut off microphone bias output 227, thus significantly reducing power consumption.

The programmability of switches S1 and S2 and potentiometers 277 and 278 is beneficial because it allows audio processor 220 to interoperate with a wide variety of power sources and microphone types. If a given microphone requires a particularly low noise bias voltage or current, audio processor 220 may employ a particularly low noise audio power supply 250. For a different microphone that does not have a similar low noise requirement, on-chip or off-chip power supply 252 or 254 can be programmably selected instead. For example, if a given microphone requires a 1.2 volt bias voltage, audio processor 220 can provide a 1.2 volt bias voltage from, for instance, a 3.0 volt off-chip power source in one programmed configuration, or from, for instance, a 2.2 volt on-chip power source in another programmed configuration. The programmability of audio processor 220 also allows it to compensate for a power source that provides a voltage that may decline over time, e.g. a battery. Audio processor 220 can be occasionally reprogrammed, if necessary, to provide a constant bias voltage as the battery voltage declines.

Figure 3:
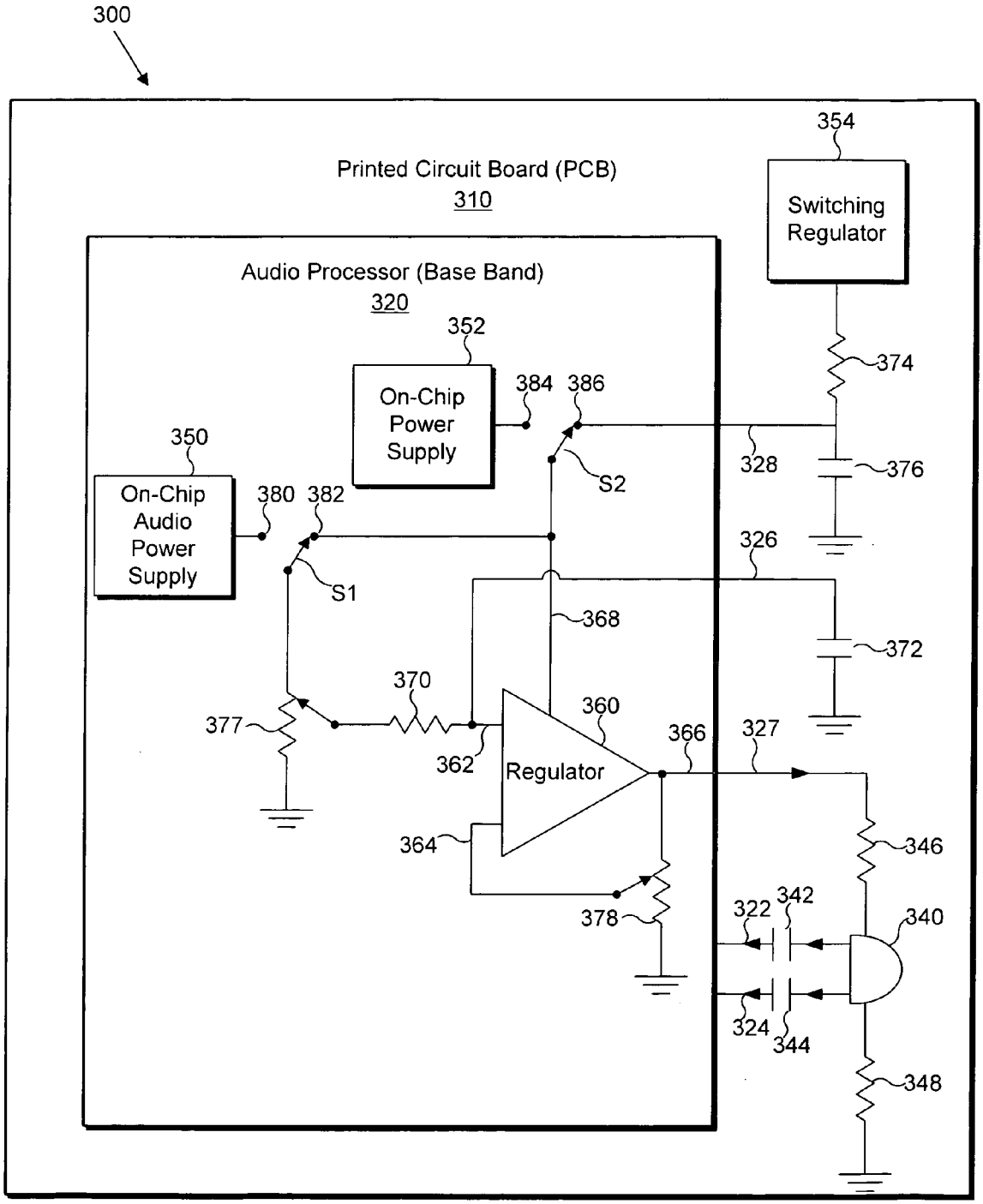
FIG. 3 shows an audio processor for generating a programmable microphone bias output, according to another embodiment of the present invention.

System 300 that includes a typical microphone for converting sound into electrical signals, in accordance with one embodiment of the invention, is shown in FIG. 3. Several components are situated on PCB 310 that correspond to components in system 200, including audio processor or base band processor 320 (hereinafter collectively referred to as "audio processor 320" for simplicity or also as a "programmable integrated circuit") and microphone 340. Switching regulator 354 replaces off-chip power supply 254 situated on PCB 210. The output of switching regulator 354 is coupled to a first terminal of resistor 374, and a second terminal of resistor 374 is coupled to a first terminal of filter capacitor 376 and to power supply input 328. A second terminal of filter capacitor 376 is connected to ground.

In operation, resistor 374 and filtering capacitor 376 filter out noise produced by switching regulator 354, so that power supply input 328 is less noisy. Audio processor 320 is similar to audio processor 220, except that in audio processor 320 switch S2 has been programmed to permanently couple node 386 to bias input 368 of regulator 360, and switch S1 has been programmed to permanently couple node 382 to potentiometer 377 and to reference input 362. With this configuration, the filtered output of switching regulator 354 is permanently coupled to bias input 368 of regulator 360 and also to potentiometer 377 and reference input 362. The output of switching regulator 354 is programmably scaled by potentiometer 377, and provided as reference input 362 to regulator 360 which in turn provides microphone bias output 327 to microphone 340. In this embodiment, the relatively noisy output provided by switching regular 354 is filtered and effectively used to provide a programmable and low noise microphone bias 327 for microphone 340.

From the above description of the invention it is manifest that various techniques can be used for implementing the concepts of the present invention without departing from its scope. Moreover, while the invention has been described with specific reference to certain embodiments, a person of ordinary skill in the art would recognize that changes can be made in form and detail without departing from the spirit and the scope of the invention. The described embodiments are to be considered in all respects as illustrative and not restrictive. It should also be understood that the invention is not limited to the particular embodiments described herein, but is capable of many rearrangements, modifications, and substitutions without departing from the scope of the invention.

Thus, an integrated and programmable microphone bias generation has been described.

The invention claimed is:

1. A programmable integrated circuit for generating a microphone bias, said programmable integrated circuit comprising:

a programmable reference input, said programmable reference input being programmably generated from at least one power source;

a programmable output to programmably generate said microphone bias;

another input coupled to said programmable output.

2. The programmable integrated circuit of claim 1, wherein said programmable integrated circuit is an audio processor.

3. The programmable integrated circuit of claim 1, wherein said programmable integrated circuit is a base band processor.

4. The programmable integrated circuit of claim 1, wherein said programmable integrated circuit resides in a single chip.

5. The programmable integrated circuit of claim 1, wherein said programmable reference input is programmed by a first potentiometer.

6. The programmable integrated circuit of claim 1, wherein said programmable output is programmed by a second potentiometer.

7. The programmable integrated circuit of claim 1, wherein said at least one power source is selected from the group consisting of an on-chip audio power supply, an on-chip power supply, and an off-chip power supply.

8. The programmable integrated circuit of claim 1, further comprising a programmable bias input coupled to a regulator in said programmable integrated circuit, said programmable bias input being programmably selected from said at least one power source.

9. The programmable integrated circuit of claim 8, wherein said programmable reference input is programmed by a first potentiometer.

10. The programmable integrated circuit of claim 8, wherein said programmable output is programmed by a second potentiometer.

11. The programmable integrated circuit of claim 1, further comprising a regulator, said regulator receiving said programmable reference input and a programmable bias input, and outputting said programmable output.

12. The programmable integrated circuit of claim 11, wherein said regulator is a high gain operational amplifier.

13. The programmable integrated circuit of claim 11, wherein said programmable bias input is selected by a first switch from the group consisting of an on-chip power supply and an off-chip power supply.

14. The programmable integrated circuit of claim 11, wherein said programmable reference input is selected by a second switch from the group consisting of an on-chip audio power supply, an on-chip power supply, and an off-chip power supply.

15. The programmable integrated circuit of claim 1, wherein said programmable reference input is filtered to remove noise.

16. The programmable integrated circuit of claim 15, wherein said programmable reference input is filtered in part by an off-chip capacitor.

17. The programmable integrated circuit of claim 1, wherein said microphone bias is coupled to a microphone.

18. The programmable integrated circuit of claim 17, wherein said microphone is not situated in said programmable integrated circuit.

19. A programmable integrated circuit for generating a microphone bias, said programmable integrated circuit comprising:

a programmable reference input, said programmable reference input being generated from a switching regulator;

a programmable output to programmably generate said microphone bias.

20. The programmable integrated circuit of claim 19, wherein said programmable reference input is programmed by a first potentiometer.

* * * * *